US008869444B2

(12) United States Patent
Bosco

(10) Patent No.: US 8,869,444 B2
(45) Date of Patent: Oct. 28, 2014

(54) FOREARM-GRIPPING STABILIZING ATTACHMENT FOR A HANDGUN

(71) Applicant: Alessandro Roberto Bosco, St. Petersburg, FL (US)

(72) Inventor: Alessandro Roberto Bosco, St. Petersburg, FL (US)

( * ) Notice: Subject to any disclaimer, the term of this patent is extended or adjusted under 35 U.S.C. 154(b) by 0 days.

(21) Appl. No.: 13/775,760

(22) Filed: Feb. 25, 2013

(65) Prior Publication Data

US 2014/0144061 A1 May 29, 2014

Related U.S. Application Data

(60) Provisional application No. 61/730,077, filed on Nov. 27, 2012.

(51) Int. Cl.
*F41C 23/10* (2006.01)
*F41C 23/12* (2006.01)
*F41C 33/00* (2006.01)

(52) U.S. Cl.
CPC ..... *F41C 23/12* (2013.01); *F41C 23/10* (2013.01); *F41C 33/001* (2013.01)
USPC ..... 42/94; 42/71.01; 42/71.02

(58) Field of Classification Search
USPC ..... 42/94, 1.09, 1.11, 1.12, 1.16, 52, 71.01, 42/71.02; 135/71; 421/94, 1.09, 1.11, 421/1.12, 1.16, 52, 71.01, 71.02
See application file for complete search history.

(56) References Cited

U.S. PATENT DOCUMENTS 104,087 A * 6/1870 Werner ..... 42/52
530,467 A * 12/1894 Balensiefer ..... 42/43
1,656,453 A * 1/1928 Tatum ..... 42/52
2,436,175 A 5/1942 Neal
2,424,194 A * 7/1947 Sampson et al. ..... 42/72
3,162,966 A * 12/1964 La Coss ..... 42/72
3,324,588 A * 6/1967 Gilbert ..... 42/71.01
3,442,042 A * 5/1969 Gilbert ..... 42/73
3,553,878 A * 1/1971 Canon ..... 42/94
3,609,902 A * 10/1971 Casull ..... 42/62
3,648,396 A 3/1972 Smith
3,685,194 A 8/1972 Coon
3,793,759 A * 2/1974 Deckard ..... 42/1.11
3,987,571 A * 10/1976 Orozco ..... 42/71.01
4,196,742 A * 4/1980 Owen, Jr. ..... 135/71
4,271,623 A 6/1981 Beretta
4,291,482 A 9/1981 Bresan
4,398,365 A * 8/1983 Pokhis ..... 42/1.11
5,180,874 A 1/1993 Troncoso, Jr
5,379,179 A * 1/1995 Graves ..... 361/232
5,852,253 A * 12/1998 Baricos et al. ..... 89/1.41
6,016,620 A 1/2000 Morgan (Continued)

*Primary Examiner* — Bret Hayes
(74) *Attorney, Agent, or Firm* — Maxey Law Offices, PLLC; Stephen Lewellyn

(57) ABSTRACT

A forearm-gripping stabilizing attachment for a handgun that has a support structure extending rearwardly from the rear end of the handgun is provided. The forearm-gripping stabilizing attachment includes a body having a passage longitudinally extending therein. The support structure of the handgun is telescopically receivable by the passage to secure the stabilizing attachment to the handgun. The body is further configured to receive and grip a user's forearm such that the support structure extends along the user's forearm. The stabilizing attachment is particularly useful in aiding a physically disabled user with handling the handgun because the handgun essentially becomes an extension of the user's forearm such that the user may actually release his or her grip from the handgun to relax the user's hand between firing while still maintaining proper control of the handgun at all times.

14 Claims, 3 Drawing Sheets

(56) References Cited

U.S. PATENT DOCUMENTS

| | | | | |
|---|---|---|---|---|
| 6,279,591 | B1 * | 8/2001 | Obitts | 135/67 |
| 6,651,371 | B2 | 11/2003 | Fitzpatrick | |
| 6,789,344 | B2 * | 9/2004 | Cain | 42/94 |
| 7,028,427 | B2 | 4/2006 | Crawford | |
| 7,059,502 | B2 * | 6/2006 | Johnson | 224/150 |
| 7,162,822 | B1 * | 1/2007 | Heayn et al. | 42/73 |
| 7,197,844 | B2 * | 4/2007 | Benson | 42/94 |
| 7,422,025 | B1 * | 9/2008 | Waldstreicher et al. | 135/71 |
| 8,051,596 | B1 * | 11/2011 | Thomas, Jr. | 42/94 |
| 8,061,072 | B1 * | 11/2011 | Crose | 42/73 |
| 8,091,264 | B2 | 1/2012 | Goertz | |
| 8,109,026 | B1 | 2/2012 | Bentley et al. | |
| 2007/0017138 | A1 * | 1/2007 | Young | 42/71.01 |
| 2009/0049731 | A1 * | 2/2009 | Seuk | 42/94 |
| 2011/0265364 | A1 * | 11/2011 | Hayden | 42/1.11 |

* cited by examiner

FOREARM-GRIPPING STABILIZING ATTACHMENT FOR A HANDGUN

CROSS-REFERENCE TO RELATED APPLICATIONS

This application claims the benefit of provisional patent application Ser. No. 61/730,077, filed Nov. 27, 2012, the entirety of which is incorporated herein by reference.

FIELD OF THE INVENTION

The present invention relates generally to a stabilizing attachment for a handgun and, more particularly, to a forearm-gripping stabilizing attachment for a handgun that secures to a rearward end of the handgun frame and engages a user's forearm.

BACKGROUND OF THE INVENTION

The accuracy and proficiency of firing a handgun greatly depends upon the user's ability to hold the handgun in a steady position while firing, which becomes more difficult in one handed operation. Holding a handgun in a steady position can be a difficult challenge to person having a physical disability that prevents that person from being able to firmly grip the handgun or steady the handgun for any appreciable length of time to permit accurate firing. This becomes an even further challenge when the weight of the handgun is concentrated forwardly of the pistol grip and causes the handgun to want to dip forwardly and, thus, require the user to compensate for this imbalance by continuously applying an upwardly force upon the grip to bring the handgun into a correct firing position.

There exist a number of devices that attach to firearms and, particularly, handguns to aid a person in holding and stabilizing the handgun during firing. While these devices meet their respective requirements and objectives, there exists a need for an improved stabilizing attachment for a handgun.

SUMMARY OF THE INVENTION

Embodiments of the present invention addresses this need by providing a new and specially designed stabilizing attachment that secures to the rearward end of a handgun and which grips a user's forearm via a pair of oppositely disposed and resilient flap members that apply a gripping force upon a user's forearm that is positioned between the flap members.

In general, in one aspect, a forearm-gripping stabilizing attachment for a handgun, the handgun having a support structure extending rearwardly from the rear end of the handgun, is provided. The forearm-gripping stabilizing attachment includes a body having a passage longitudinally extending therein and at least through a front end of the body. The support structure of the handgun is telescopically receivable by the passage. The body is further configured to receive and grip a user's forearm such that the support structure extends along the user's forearm.

In general, in another aspect, a combination of a forearm-gripping stabilizing attachment and a handgun is provided. The combination includes a support structure extending rearwardly outward from the handgun. And the forearm-gripping stabilizing attachment includes a body having a passage longitudinally extending therein and at least through a front end of the body. The support structure of the handgun is telescopically received by the passage. The body is also configured to receive and grip a user's forearm such that the support structure extends along the user's forearm.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of present, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated an embodiment of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

As a preliminary matter, it should be noted that in this document directional terms, such as "above", "below", "upper", "lower", etc., are used for convenience in referring to the accompanying drawings.

Figure 1:
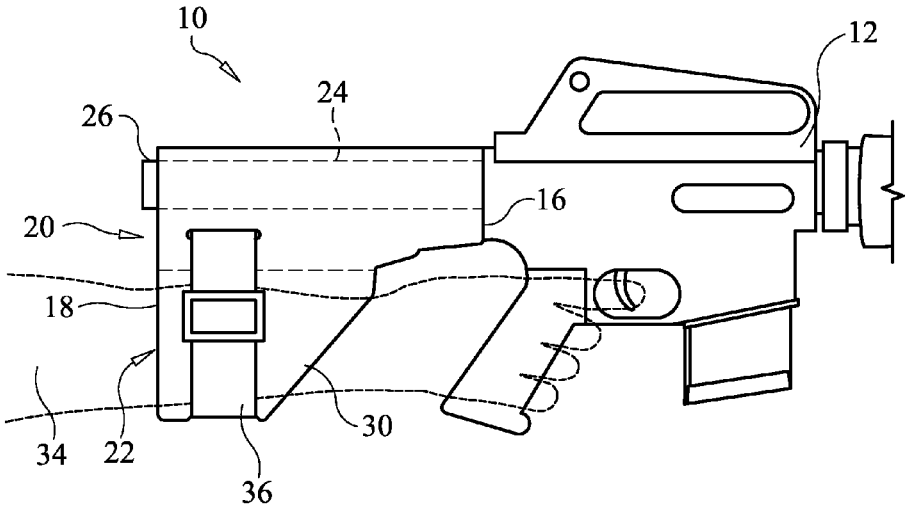
FIG. 1 is a side elevation view of the forearm-gripping stabilizing attachment for a handgun constructed in accordance with the principles of an embodiment of the present invention, illustrating the stabilizing attachment in use and attached to a handgun.
Figure 2:
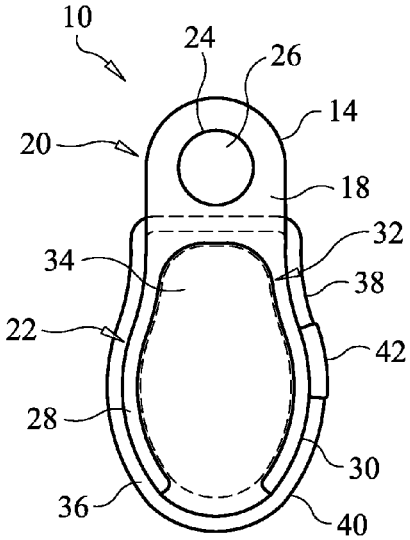
FIG. 2 is a partial rear elevation view of the forearm-gripping stabilizing attachment for a handgun of FIG. 1, illustrating the stabilizing attachments engagement with a user's forearm.
Figure 3:
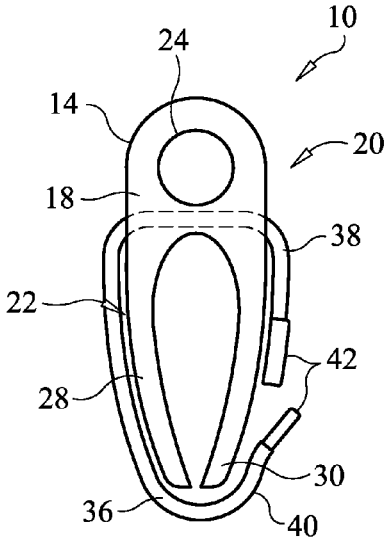
FIG. 3 is a rear elevation view of the forearm-gripping stabilizing attachment for a handgun constructed in accordance with the principles of an embodiment of the present invention, illustrating the stabilizing attachment in a non-use configuration.

In FIGS. 1 through 3, there is representatively illustrated a specially designed stabilizing attachment 10, for mounting to a handgun 12, that permits a user to handle and support a handgun without straining the user's arm, hand, or wrist. Stabilizing attachment 10 is particularly advantageous for a person having a physical disability that would prevent the person from handling and supporting the handgun for an appreciable amount of time. Stabilizing attachment 10 is also particularly useful with handguns having a large portion of its weight located forwardly of the pistol grip that causes a user to strain to properly hold the handgun in a correct firing position.

Stabilizing attachment 10 comprises body 14, which in an embodiment, is made substantially of a semi-rigid, elastomeric material. As a non-limiting example, body 14 could be made of rubber, foam-rubber or the like material. Body 14 includes a forward end 16, a rearward end 18, an elongated upper body portion 20 that extends between the forward and rearward ends, and a lower body portion 22 that extends from the rearward end towards the forward end and terminates prior to the forward end. Body 14 is unitary and generally tapers from narrow to wide in a direction from the forward end 16 towards the rearward end 18. The body 14 has a swept design that generally conforms to the angle between the user's forearm and the handgun when the user grips the handgun.

The upper body portion 20 includes a longitudinal passage 24 that extends completely through the body 14 between the forward and rearward ends 16 and 18. Passage 24 provides for the telescopic insertion of a portion of the handgun 12 therein to secure or mount the stabilizing attachment 10 to the handgun. As illustrated here, and in an embodiment, handgun 12 includes a buffer tube 26 or the like that extends rearwardly from the handgun. The stabilizing attachment 10 is mounted or secured to the handgun 12 by inserting the buffer tube 16 completely through passage 24 with the forward end 16 of body 14 first. It is preferred that body 14 is sized such that when the buffer tube 26 is fully inserted through passage 24 it partially extends outwardly from the passage and beyond the rearward end 18 of the body. This is desired in order to prevent improper use of the stabilizing attachment 10 where a user may be inclined to improperly shoulder the stabilizing attachment. In an embodiment, buffer tube 16 is frictionally retained within passage 24; however, other means of restraining the withdrawal of the buffer tube from the passage could be employed.

Lower body portion 22 is longitudinally bi-furcated and includes downwardly depending opposed flaps 28 and 30. Flaps 28 and 30 are laterally spaced and form a gap 32 therebetween into which is positioned the forearm 34 of a user with the flaps disposed on opposite lateral sides of the user's forearm, as best seen in FIG. 2. Flaps 28 and 30, being of the semi-rigid elastomeric material, conform to the user's forearm 34. Flaps 28 and 30 may be formed in a manner such that they apply oppositely directed inward forces upon the user's forearm 34 to grip the forearm and prevent the forearm from slipping outward from between the flaps.

Stabilizing attachment 10 may also include a securement strap 36 that encircles the flaps 28 and 30, and the user's forearm when the forearm is disposed between the flaps. Securement strap 36 may be of any suitable strap that is capable of being cinched about the flaps and the user's forearm. In the illustrated embodiment, securement strap 36 is laterally threaded through body 14 between passage 24 and gap 32. Opposite ends 38 and 40 of the strap 36 are secured together by a suitable buckle or clasp 42. One of ordinary skill in the art will readily appreciate the function of strap 36 and recognize many suitable arrangements for the purpose of securing the body 14 about a user's forearm.

Alternative embodiments are possible and within the scope of the invention. For example, while the body 14 has been described as being formed entirely of a resilient material, it is possible to form the body such that various components of the body are of different materials. As a non-limiting example, the upper portion 20 could be formed of a rigid or non-elastomeric material and the lower portion 22 could be formed of a resilient material that could be over molded or otherwise joined with the upper portion. Other constructions are possible that remain within the scope of the invention so long as the opposed flaps 28 and 30 at least partially conform to a user's forearm.

Figure 4:
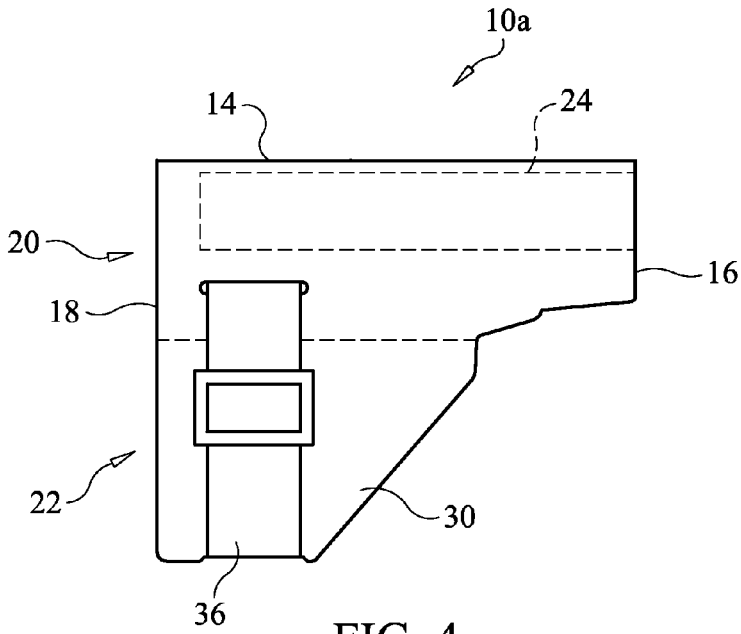
FIG. 4 is side elevation view of a forearm-gripping stabilizing attachment for a handgun constructed in accordance with the principles of an alternative embodiment of the present invention.

With reference to FIG. 4 there is representatively illustrated an alternative embodiment of a stabilizing brace 10*a* and wherein like reference numbers refer to similar elements of previously disclosed embodiments. In stabilizing brace 10*a*, passage 24*a* is substituted for passage 24. Passage 24*a*, unlike passage 24, does not fully extend through the body 14 between the forward and rearward ends 16 and 18. And rather passage 24*a* terminates within the body, such as, for example, approximate to end 18. In other words, passage 24*a* is a blind passage extending through end 16 and terminating at position within body 14 prior to end 18.

In this instance, the buffer tube 26 or other suitable tubular support structure extending rearwardly from the handgun is received within passage 24*a* but does not extend beyond end 18 as in stabilizing attachment 10. While, as discussed above, this may not be a preferred embodiment, it is a possible alternative that is within the scope of the present invention.

Figure 5:
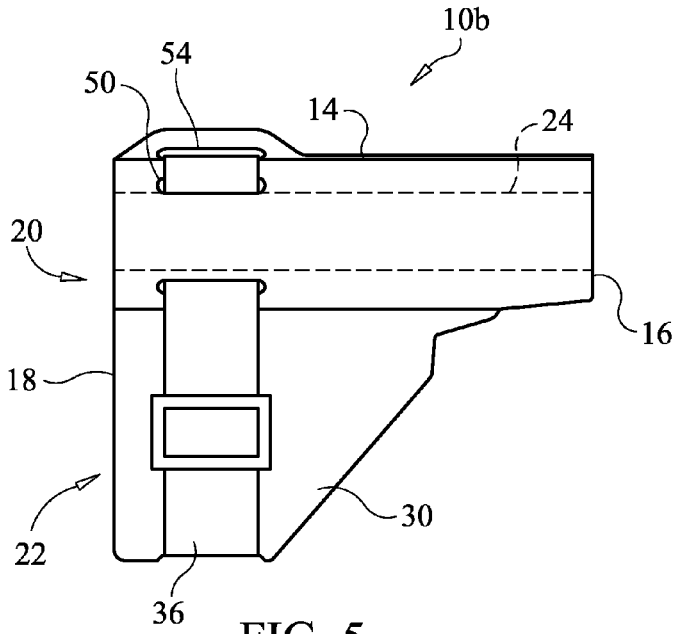
FIG. 5 is a side elevation view of a forearm-gripping stabilizing attachment for a handgun constructed in accordance with the principles of an alternative embodiment of the present invention.
Figure 6:
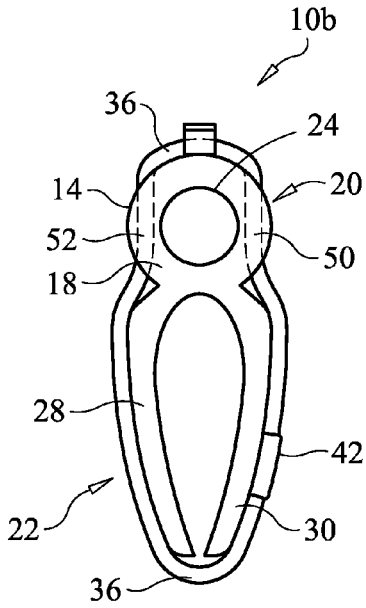
FIG. 6 is a rear elevation view of the forearm-gripping stabilizing attachment of FIG. 5.

Now with reference to FIGS. 5 and 6 there is representatively illustrated stabilizing brace 10*b* constructed in accordance with another embodiment of the present invention, wherein all like reference numbers refer to similar elements of previously disclosed embodiments. Stabilizing brace 10*b* further includes a pair of slots 50 and 52 vertically extending through the upper portion 22 of the body 14 and on opposite sides of passage 24. Stabilizing brace 10*b* may also further include a third slot 54 disposed above passage 24. Securement strap 36 is thread through slots 50, 52 and 54 so as to encircle passage 24 and flap portions 28 and 30 alike. It is contemplated that this securement strap arrangement of stabilizing brace 10*b*, that encircles passage 24, may provide a more secure attachment of the stabilizing brace to the forearm of a user over the previously disclosed embodiments where the securement strap only encircles flap portions 28 and 30.

Figure 7:
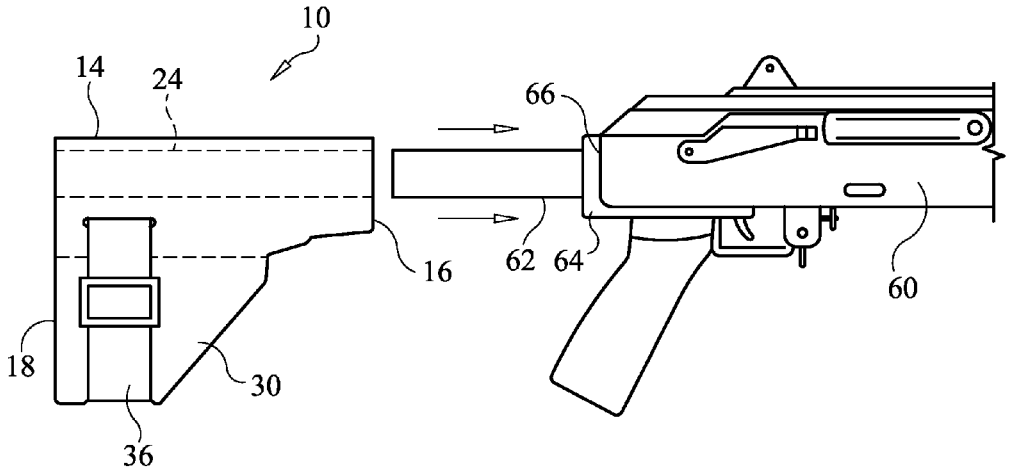
FIG. 7 is a side elevation view of a forearm-gripping stabilizing attachment for a handgun constructed in accordance with the principles of an alternative embodiment of the present invention.
Figure 8:
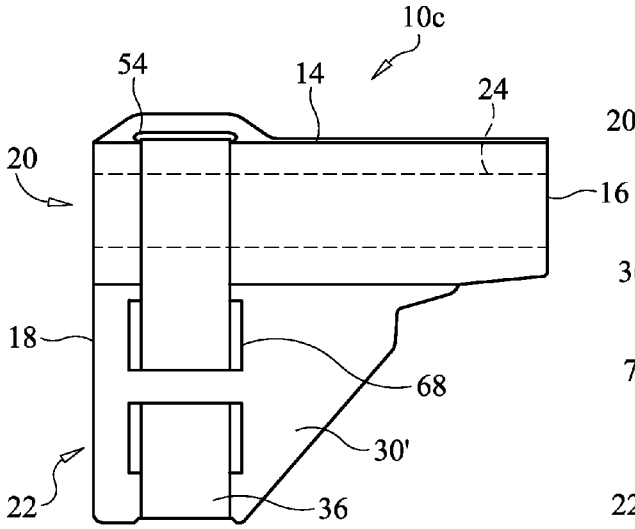
FIG. 8 is a rear elevation view of the forearm-gripping stabilizing attachment of FIG. 7.

With reference now to FIGS. 7 and 8 there is representatively illustrated stabilizing brace 10*c* constructed in accordance with another embodiment of the present invention, wherein all like reference numbers refer to similar elements of previously disclosed embodiments. Stabilizing brace 10*c* includes flap portions 28' and 30' that further include slots 68 and 70, respectively, through which the strap 36 is threaded. This strap configuration of stabilizing brace 10*c* illustrates yet another exemplary configuration that is within the scope of the invention.

Figure 9:
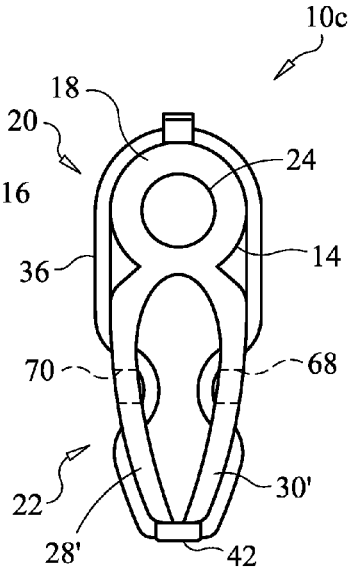
FIG. 9 is a side elevation view of a forearm-gripping stabilizing attachment constructed in accordance with the principles of the present invention in use with a handgun of an alternative configuration of the handgun illustrated in FIG. 1.

With reference now to FIG. 9, stabilizing brace 10 (or alternative embodiments) is representatively illustrated in connection with hand gun 60 that has a different configuration from hand gun 12 (seen in FIG. 1). Particularly, hand gun 12 includes an integral buffer tube 26 that provides a suitable support upon which the stabilizing brace 10 may be attached by telescopically receiving the buffer tube within passage 24. But not every hand gun is provided with a suitable tubular support or similar structure that rearwardly extends from the hand gun to which the stabilizing brace 10 may be attached. Thus it is contemplated that a suitable attachment structure, such as, tubular member 62 or the like may be provided for attachment to a hand gun that otherwise is devoid of a suitable structure to which the stabilizing brace 10 may be attached.

In the exemplary illustration, tubular member 62 is secured to a bracket 64 that is secured to the hand gun 60, thereby attaching tubular member to the hand gun such that the tubular member 62 extends rearwardly outward from the butt end or rear end 66 of the hand gun. To this end, the tubular member 62 is securely attached to the hand gun 60 and thus provides a suitable support to which the stabilizing brace 10 may be attached by telescopically receiving the tubular member within passage 24. There are numerous possible bracket configurations that could be employed to complement various hand gun structures. Thus impracticable to disclose the myriad of possibilities and one of ordinary skill in the art will readily appreciate that providing a suitable support structure for attachment to a hand gun by some sort of bracket mount is the important aspect of the invention and not the actual configuration of the bracket.

While not illustrated, it is contemplated that the flap portions 28 and 30 could be constructed to be hinged so as to conform to the users forearm and provide gripping of the forearm. In this configuration, the flap portions 28 and 30 may be made of a resilient material or may be made of a more rigid material, such as, but not limited to plastics, metal, alloys, and the like.

Further, one of ordinary skill in the art and a user will readily appreciate the many benefits of using the forearm-gripping stabilizing attachment of this invention for one handed firing of a handgun. Particularly, the weight of the handgun is more evenly distributed through the user's hand, wrist, and forearm. Additionally, the handgun becomes an extension of the user's forearm wherein the user may actually release his or her grip from the handgun to relax the user's hand between firing while still maintaining proper control of the handgun at all times. Additionally yet, a user will tend to have better accuracy and aim when firing a handgun while utilizing the invention.

A number of embodiments of the present invention have been described. Nevertheless, it will be understood that various modifications may be made without departing from the spirit and scope of the invention and the following claims.

What is claimed is:

1. A forearm-gripping stabilizing attachment for a handgun, the handgun having a support structure extending rearwardly from the rear end of the handgun, the forearm-gripping stabilizing attachment, comprising:

a body having a front end, a rear end, an upper portion, a lower portion, and a passage longitudinally extending within said upper portion and at least through said front end of said body, the support structure of the handgun being telescopically receivable by said passage;

said lower portion being bifurcated so as to define a pair of spaced flaps between which a user's forearm is received when securing the stabilizing attachment to the user's forearm; and a strap connected to said body, said strap securing said spaced flaps to retain the user's forearm between said spaced flaps when the stabilizing attachment is secured to a user's forearm.

2. The forearm-gripping stabilizing attachment of claim 1, wherein said spaced flaps are constructed of an elastomeric material and at least partially conform to and grip a user's forearm when the user's forearm is disposed between said spaced flaps.

3. The forearm-gripping stabilizing attachment of claim 1, wherein said passage extends entirely through said body between said front end and said rear end of said body.

4. The forearm-gripping stabilizing attachment of claim 1, wherein said strap encircles said spaced flaps.

5. The forearm-gripping stabilizing attachment of claim 4, wherein said strap further encircles said passage.

6. In combination a forearm-gripping stabilizing attachment and a handgun, the combination comprising:

a support structure extending rearwardly outward from the handgun;

the forearm-gripping stabilizing attachment comprising:

a body having a front end, a rear end, an upper portion, a lower portion, and a passage longitudinally extending within said upper portion and at least through said front end of said body, the support structure of the handgun being telescopically received by said passage;

said lower portion being bifurcated so as to define a pair of spaced flaps between which a user's forearm is received when securing the stabilizing attachment to the user's forearm; and a strap connected to said body, said strap securing said spaced flaps to retain the user's forearm between said spaced flaps when the stabilizing attachment is secured to a user's forearm.

7. The combination of claim 6, wherein said support structure is a buffer tube.

8. The combination of claim 6, wherein said support structure is other than a buffer tube.

9. The combination of claim 6, further comprising:

a bracket, said bracket secured to said handgun and said support structure secured to said bracket.

10. A forearm-gripping stabilizing attachment for a handgun, the handgun having a support structure extending rearwardly from the rear end of the handgun, the forearm-gripping stabilizing attachment, comprising:

a body having a passage longitudinally extending therein and at least through a front end of said body, the support structure of the handgun being telescopically receivable by said passage;

said body defining a space within which a user's forearm is removably receivable;

a strap connected to said body, said strap preventing withdrawal of a user's forearm from said space when the forearm gripping stabilizing attachment is secured to the user's forearm; and wherein said body is bifurcated and defines a pair of spaced flaps, said pair of spaced flaps defining said space within which the user's forearm is removably receivable.

11. The forearm-gripping stabilizing attachment of claim 10, wherein said pair of spaced flaps are constructed of an elastomeric material.

12. The forearm-gripping stabilizing attachment of claim 11, wherein said pair of spaced flaps at least partially conform to a user's forearm when the user's forearm is disposed between said pair of space flaps.

13. The forearm-gripping stabilizing attachment of claim 10, wherein said passage extends entirely through said body between said front end and said rear end of said body.

14. The forearm-gripping stabilizing attachment of claim 10, wherein said strap encircles said passage and said spaced flaps.

* * * * *

(12) INTER PARTES REVIEW CERTIFICATE (3186th)

United States Patent

Bosco

(10) Number: US 8,869,444 K1

(45) Certificate Issued: Jul. 17, 2023

(54) FOREARM-GRIPPING STABILIZING ATTACHMENT FOR A HANDGUN

(71) Applicant: Alessandro Roberto Bosco

(72) Inventor: Alessandro Roberto Bosco

(73) Assignee: NST GLOBAL LLC

Trial Number:

IPR2020-00423 filed Jan. 23, 2020

Inter Partes Review Certificate for:

Patent No.: 8,869,444
Issued: Oct. 28, 2014
Appl. No.: 13/775,760
Filed: Feb. 25, 2013

The results of IPR2020-00423 are reflected in this inter partes review certificate under 35 U.S.C. 318(b).

INTER PARTES REVIEW CERTIFICATE
U.S. Patent 8,869,444 K1
Trial No. IPR2020-00423
Certificate Issued Jul. 17, 2023

AS A RESULT OF THE INTER PARTES REVIEW PROCEEDING, IT HAS BEEN DETERMINED THAT:

Claims 2, 7, 11 and 12 are found patentable.

Claims 1, 3-6, 8-10, 13 and 14 are cancelled.

* * * * *